US008434738B1

(12) United States Patent
Anstett

(10) Patent No.: US 8,434,738 B1
(45) Date of Patent: May 7, 2013

(54) FLOORING INSTALLATION TOOL

(75) Inventor: Todd J. Anstett, Palatine, IL (US)

(73) Assignee: Powernail Company, Lake Zurich, IL (US)

( * ) Notice: Subject to any disclaimer, the term of this patent is extended or adjusted under 35 U.S.C. 154(b) by 400 days.

(21) Appl. No.: 12/880,813

(22) Filed: Sep. 13, 2010

(51) Int. Cl.
*B66F 3/02* (2006.01)

(52) U.S. Cl.
USPC ..... 254/12; 254/11; 254/13; 254/14; 254/15; 254/16

(58) Field of Classification Search ..... 254/11, 254/12, 13, 14, 15, 16, 112, 118, 134, 133 R; 81/46
See application file for complete search history.

(56) References Cited

U.S. PATENT DOCUMENTS

| | | | |
|---|---|---|---|
| 10,061 | A | 9/1853 | Parrish |
| 14,076 | A | 4/1856 | Oliver |
| 49,852 | A | 9/1865 | Bryant |
| 136,428 | A | 3/1873 | Foster |
| 146,869 | A | 1/1874 | Bucklin, Jr. |
| 153,422 | A | 7/1874 | Chilson |
| 178,389 | A | 6/1876 | Mason |
| 178,677 | A | 6/1876 | Shaw |
| 201,709 | A | 3/1878 | Schofield |
| 214,078 | A | 4/1879 | Austin |
| 280,113 | A | 6/1883 | Allen |
| 284,747 | A | 9/1883 | Margot |
| 299,220 | A | 5/1884 | Hatch |
| 302,416 | A | 7/1884 | Lobdell |
| 319,464 | A | 6/1885 | Dearth |
| 322,369 | A | 7/1885 | Groce |
| 352,120 | A | 11/1886 | Dearth |
| 364,794 | A | 6/1887 | Bradley |
| 376,439 | A | 1/1888 | Holmes |
| 386,545 | A | 7/1888 | Lusk |
| 420,288 | A | 1/1890 | Warren et al. |
| 466,142 | A | 12/1891 | Schade |
| 475,855 | A | 5/1892 | Graham |
| 488,147 | A | 12/1892 | Martin |
| 489,405 | A | 1/1893 | Anthony |
| 529,929 | A | 11/1894 | Marston |

(Continued)

OTHER PUBLICATIONS

Powernail Co. Inc. PowerJack Flooring Jack. Powernail Co., Inc. Date: 1995.

(Continued)

*Primary Examiner* — George Nguyen
(74) *Attorney, Agent, or Firm* — Jansson Munger McKinley & Shape Ltd.

(57) ABSTRACT

Jack-type tools for moving elements such as flooring elements by pulling and, alternatively, by pushing are shown and described. In an embodiment, the jack includes a base, a puller pivotably attached to the base, a ram extendable from the base, and a ram-drive mechanism in power-transmission relationship with the ram which is operative to extend the ram. The pivotably attached puller contacts a flooring element side portion during a pulling mode of operation and pivots out of the way so that the jack can push a flooring element during a pushing mode of operation. The ram extends from the base against a fixed surface such as a wall or cabinet to apply a force which pulls the flooring element with the puller to move the puller and flooring element away from the fixed surface and, alternatively, a force which pushes the flooring element by extension of the ram with the tool secured with respect to a subfloor or other support.

25 Claims, 7 Drawing Sheets

U.S. PATENT DOCUMENTS

| | | | | | |
|---|---|---|---|---|---|
| 534,590 | A | | 2/1895 | Wallace | |
| 561,003 | A | | 5/1896 | Kinderman | |
| 577,975 | A | | 3/1897 | Bunnell | |
| 597,671 | A | | 1/1898 | Dutt | |
| 710,169 | A | | 9/1902 | Tretsven | |
| 716,465 | A | | 12/1902 | Nicholls, Sr. | |
| 719,335 | A | | 1/1903 | Hoekstra | |
| 737,691 | A | | 9/1903 | Adams | |
| 769,076 | A | | 8/1904 | Hammond et al. | |
| 788,045 | A | | 4/1905 | Hammond et al. | |
| 796,968 | A | | 8/1905 | Herr | |
| 907,959 | A | | 12/1908 | Biladeau | |
| 909,408 | A | | 1/1909 | Hendrickson | |
| 922,930 | A | | 5/1909 | Marsh | |
| 950,673 | A | | 3/1910 | Marsh | |
| 951,557 | A | | 3/1910 | Bruhn | |
| 964,305 | A | | 7/1910 | Oliver | |
| 975,566 | A | | 11/1910 | Norton | |
| 977,471 | A | | 12/1910 | Pickering | |
| 1,005,038 | A | | 10/1911 | Hubbard | |
| 1,013,927 | A | | 1/1912 | Chamberlain et al. | |
| 1,018,070 | A | | 2/1912 | Morehead | |
| 1,094,449 | A | | 4/1914 | Laurl | |
| 1,123,274 | A | | 1/1915 | Gross | |
| 1,142,452 | A | * | 6/1915 | Oliver | 188/67 |
| 1,145,160 | A | | 7/1915 | Meadows | |
| 1,166,691 | A | | 1/1916 | Keller et al. | |
| 1,182,284 | A | | 5/1916 | McBreairty | |
| 1,186,277 | A | | 6/1916 | Burridge | |
| 1,210,277 | A | | 12/1916 | Culp | |
| 1,220,639 | A | | 3/1917 | Kakela | |
| 1,228,214 | A | | 5/1917 | Johnson | |
| 1,231,461 | A | | 6/1917 | Tomcheck | |
| 1,313,664 | A | | 8/1919 | Aylworth et al. | |
| 1,447,720 | A | | 3/1923 | Hall | |
| 1,459,984 | A | | 6/1923 | Nelson | |
| 1,531,512 | A | | 3/1925 | Schaefer | |
| 1,569,346 | A | | 1/1926 | Wilson et al. | |
| 1,577,491 | A | * | 3/1926 | Prentice | 254/11 |
| 1,618,896 | A | | 2/1927 | Tubbs | |
| 1,918,017 | A | | 7/1933 | Christ | |
| 2,197,404 | A | | 4/1940 | Chapman et al. | |
| 2,427,268 | A | | 9/1947 | Fleming et al. | |
| 2,489,990 | A | | 11/1949 | Treaster | |
| 2,518,586 | A | | 8/1950 | Williamson | |
| 2,535,078 | A | | 12/1950 | La Mont | |
| 2,589,404 | A | | 3/1952 | Lab | |
| 2,708,097 | A | | 5/1955 | Hinger | |
| 2,710,166 | A | | 6/1955 | Miller | |
| 2,798,691 | A | | 7/1957 | Miller | |
| 2,836,394 | A | | 5/1958 | Kehoe | |
| 2,864,581 | A | * | 12/1958 | Harrison | 254/15 |
| 2,933,288 | A | * | 4/1960 | Sholick | 254/12 |
| 3,143,335 | A | | 8/1964 | Lassahn | |
| 3,939,546 | A | | 2/1976 | Hernandez | |
| 4,332,203 | A | | 6/1982 | Flowers | |
| 4,753,426 | A | * | 6/1988 | Varkala | 269/53 |
| 4,792,121 | A | | 12/1988 | Annas, Sr. et al. | |
| 5,248,127 | A | | 9/1993 | Young | |
| D353,987 | S | | 1/1995 | Pasto | |
| 5,527,014 | A | | 6/1996 | Bracewell | |
| 5,788,221 | A | | 8/1998 | Muhlebach et al. | |
| 5,826,858 | A | | 10/1998 | Gordon | |
| 5,894,705 | A | | 4/1999 | Sutton | |
| 5,964,450 | A | | 10/1999 | Pasto | |
| 6,079,182 | A | | 6/2000 | Ellenberger | |
| 6,086,048 | A | * | 7/2000 | Owen | 254/17 |
| 6,402,121 | B1 | | 6/2002 | Marcon | |
| 6,644,627 | B1 | * | 11/2003 | Forrester | 254/17 |
| 6,962,179 | B1 | | 11/2005 | Brodersen | |
| 6,969,055 | B1 | | 11/2005 | Schwind | |
| 7,226,036 | B1 | | 6/2007 | Wellman, Jr. | |
| 7,451,671 | B2 | | 11/2008 | Coleman, Jr. | |
| 2005/0155204 | A1 | | 7/2005 | Mikkelsen | |
| 2005/0247019 | A1 | | 11/2005 | Pasto | |
| 2006/0278859 | A1 | * | 12/2006 | Fraley | 254/17 |
| 2009/0194749 | A1 | | 8/2009 | Mirocha | |

OTHER PUBLICATIONS

Powernail Co., Inc. Powernail Models 100 and 200 PowerJacks. Date: 2001.

Stanley Bostitch MIII—Hardwood Flooring Jack Date: Jul. 2010. Brochure.

Stanley Bostitch MIII—Hardwood Flooring Jack. <www.fcimag.com>. p. 52. Date: Jul. 2010.

Crain Tools. Plank Floor Tools. <www.craintools.com>. No. 565 18' Strap Clamp and No. 592 Ratchet Spacers. Date: Unknown.

Hardwood Wood Floor Installation Flooring Jack. <http://cgi.ebay.com/Hardwood-Wood-Floor-Installation-Flooring-Jack-/370376221345?cmd . . . >. Date: Jul. 6, 2010.

Flooring Jack Install Hard Wood Floors New Floor Jack. <http://cgi.ebay.com/Flooring-Jack-Install-Hard-Wood-Floors-New Floor . . . >. Date: Jul. 6, 2010.

Powernail Co., Inc. Powernail PowerJack Model 100 Flooring Jack. Date: 1993.

Powernail Co., Inc. Powernail Model 100 and 200 PowerJack Flooring Jacks. Western Floors. Date: Mar. 1997.

* cited by examiner

FLOORING INSTALLATION TOOL

FIELD

The field relates to tools for applying pushing or pulling force and, more specifically, to jacks for moving one or more flooring element.

BACKGROUND

Jacks are a type of tool used to apply a force to move elements, such as the planks, boards, laminate panels and the like used for flooring construction and repair applications. These types of elements are referred to herein as "flooring elements." Jacks for use with flooring elements have a range of potential uses. For example, the jack may be used to join adjacent flooring elements tightly together so that the installer can nail or otherwise secure the flooring elements to a subfloor, joist or other support. By way of further example, the jack may be used to apply a force which moves one or more flooring element to ensure abutment between a flooring element and a baseboard molding, wall or cabinet before the element is secured in place. The force applied by the jack is useful to ensure that the flooring elements are uniform in appearance and to ensure that there are no unwanted gaps or spaces between adjacent flooring elements or surfaces.

Many jack devices have been developed to assist the installer with moving or joining flooring elements. For example, jacks exist which operate in one direction. Such jacks are capable of either pulling the flooring elements or pushing the flooring elements, but are not capable of both pulling and, alternatively, pushing the flooring elements. While these types of jacks can be satisfactory for their intended purpose, a potential shortcoming is that the installer must purchase two jacks should the installer need to both pull and push flooring elements into the desired position.

Other jack devices exist which are capable of both pulling or pushing. Examples are described in U.S. Pat. Nos. 2,933,288 (Sholick) and 7,451,671 (Coleman, Jr.) and in U.S. Patent Application Publication No. 2009/0194749 (Mirocha). A shortcoming of the jacks described in these documents is that each jack requires a pulling "foot" that is completely removable from the jack. The installer must attach the completely-removable foot to the jack to enable the jack to pull the flooring elements. Foot attachment is inconvenient and time consuming. A separate tool may be required to mount the removable foot and separate fasteners may also be required. Moreover, a removable foot is a part separate from the jack which can easily be misplaced or lost, especially during movement from job site to job site. These jacks cannot pull the flooring elements without the removable foot and loss of the removable foot partially disables the jack. The removable foot is not optimally suitable for operation with flooring elements which have a range of different thicknesses.

It would be an advance in the art to provide a jack-type tool for moving or joining elements, such as flooring elements, which would enable movement or joining of elements by pushing and, alternatively, by pulling with a single tool, which would be simple and easy to use, which would avoid loss of parts, which could include the capability of joining or moving elements having a range of different thicknesses and which would generally improve the quality of flooring installation and carpentry work.

SUMMARY

Jack-type tools for moving or joining elements, such as flooring elements, by pulling and, alternatively, by pushing are shown and described. In a preferred embodiment, the jack includes a base, a puller pivotably attached to the base, a ram extendable from the base, and a ram-drive mechanism in power-transmission relationship with the ram which is operative to extend the ram.

Preferably, the base is provided to support the jack on a subfloor adjacent the flooring element to be moved, on the top surface of one or more flooring element, or on another suitable support. It is highly preferred that the base optionally include a toe capable of placement against a flooring element top side proximate the puller to prevent lifting of the flooring element during application of a pulling force.

A preferred puller may be attached directly or indirectly to the base and is capable of pivoting movement in a first direction to contact a flooring element side portion during a pulling mode of jack operation and is further capable of movement in an opposite direction to enable the base to rest on a support with a pulling surface of the puller out of contact with a flooring element for flooring element pushing during a pushing mode of jack operation. In embodiments, the puller is capable of self-adjusting pivoting movement in the first direction for contact with the flooring element side portion based on a thickness of the flooring element.

A preferred puller may include a body pivotably attached to the base. Preferably, the attachment point is proximate the preferred toe and the body defines a slot to permit travel of the ram through the puller when the base is in position for pushing. Preferably, the body includes a flooring element contact portion in the form of a flange which extends away from the body for contact with the flooring element side portion. In an embodiment, the body includes a pair of spaced-apart arms defining at least a portion of the slot therebetween, each arm being pivotably attached to the base on an opposite side of the preferred toe. The flange preferably extends across the arms.

A preferred ram is extendable from the base and is capable of applying a pulling force and, alternatively, a pushing force. When extended against a fixed surface in a pulling mode of operation, the ram is capable of applying a force which pulls the flooring element by moving the puller and flooring element away from the fixed surface. Alternatively, in a pushing mode of operation, the ram applies a force which pushes the flooring element by extension of the ram against the flooring element side portion with the jack secured with respect to the subfloor or other support. The ram preferably comprises a bar having a distal end and a pusher attached to the bar distal end. A preferred pusher includes a front surface for contacting the fixed surface during flooring element pulling in the pulling mode of operation and, alternatively, the flooring element side portion during flooring element pushing in the pushing mode of operation.

A preferred ram-drive mechanism comprises a rack along the bar, a pinion meshed with the rack, a one-way clutch, and a lever which powers pinion rotation through the one-way clutch to extend the ram.

BRIEF DESCRIPTION OF THE DRAWINGS

Exemplary jack-type tools may be understood by reference to the following description taken in conjunction with the accompanying drawings, in which like reference numerals identify like elements throughout the different views. The drawings are not necessarily to scale, emphasis instead being placed upon illustrating the principles of the invention. In the accompanying drawings.

Figure 1:
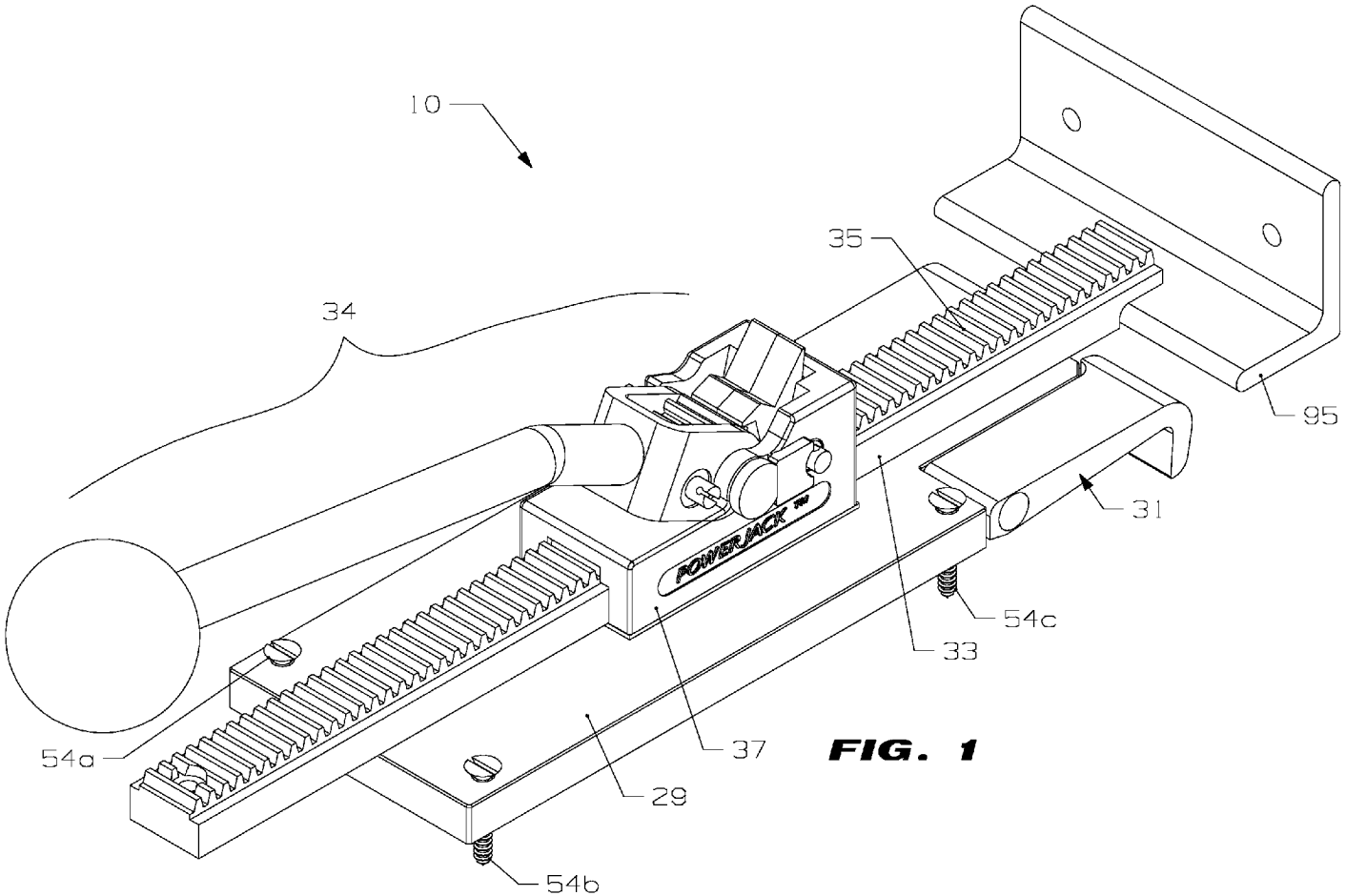
FIG. 1 is an isometric view of an exemplary jack looking toward the jack rear end.

While the apparatus is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION

An exemplary jack 10 will now be described in connection with FIGS. 1-8. Jack 10 is a type of implement or tool which exerts a force and which is most preferably used by a flooring installer for installation or repair of flooring elements. In such preferred applications, jack 10 is used to move one or more flooring elements, such as those illustrated by reference numbers 11*a*, 11*b*, 11*c*, 11*d*, 11*e*, and 11*f*, or 13*a*, 13*b*, 13*c*, 13*d*, and 13*e* or 14*a* and 14*b* in FIGS. 6-8, by pulling and, alternatively, by pushing at least one of the flooring elements. Jack 10 includes apparatus for these purposes as described herein. Since jack 10 can be used in either a pulling mode of operation or a pushing mode of operation, jack 10 advantageously consolidates the functions of separate pulling and pushing jacks into a single tool.

Jack 10 is capable of holding one or more flooring elements 11*a*-11*f*, 13*a*-13*e*, 14*a*-14*b* together enabling hands-free securing of the flooring elements to a subfloor 15, joist, or other support by means of cleats, nails, or other fasteners. The flooring elements 11*a*-11*f*, 13*a*-13*e*, 14*a*-14*b* may also be held in place by other means, such as by adhesive. Jack 10 is particularly useful for eliminating slight bends or warping of the flooring elements 11*a*-11*f*, 13*a*-13*e*, 14*a*-14*b* during installation so that the finished appearance of the floor is neat with uniform spacing between flooring elements 11*a*-11*f*, 13*a*-13*e*, 14*a*-14*b*.

Figure 6:
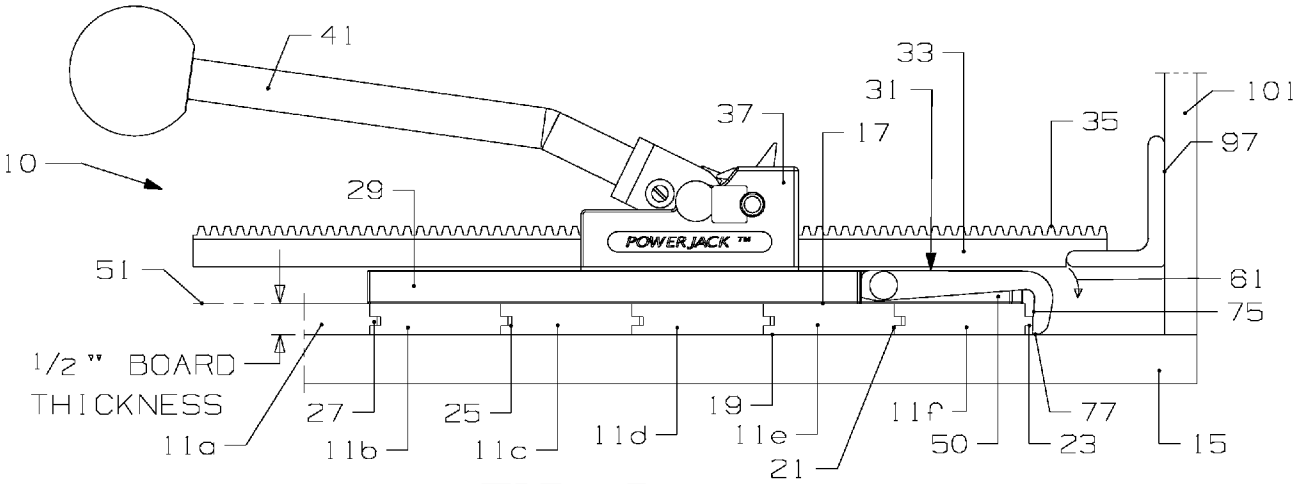
FIG. 6 is a side elevation view of the exemplary jack of FIG. 1 showing use in a pulling mode of operation with exemplary flooring elements having a nominal ½ inch thickness.
Figure 7:
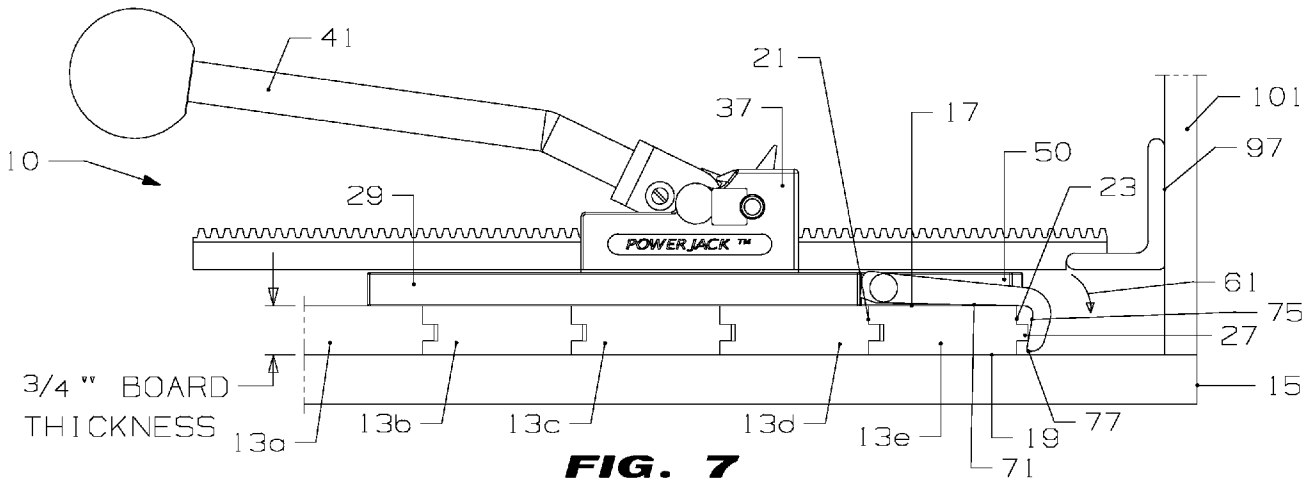
FIG. 7 is a side elevation view of the exemplary jack of FIG. 1 showing use in the pulling mode of operation with exemplary flooring elements having a nominal ¾ inch thickness.
Figure 8:
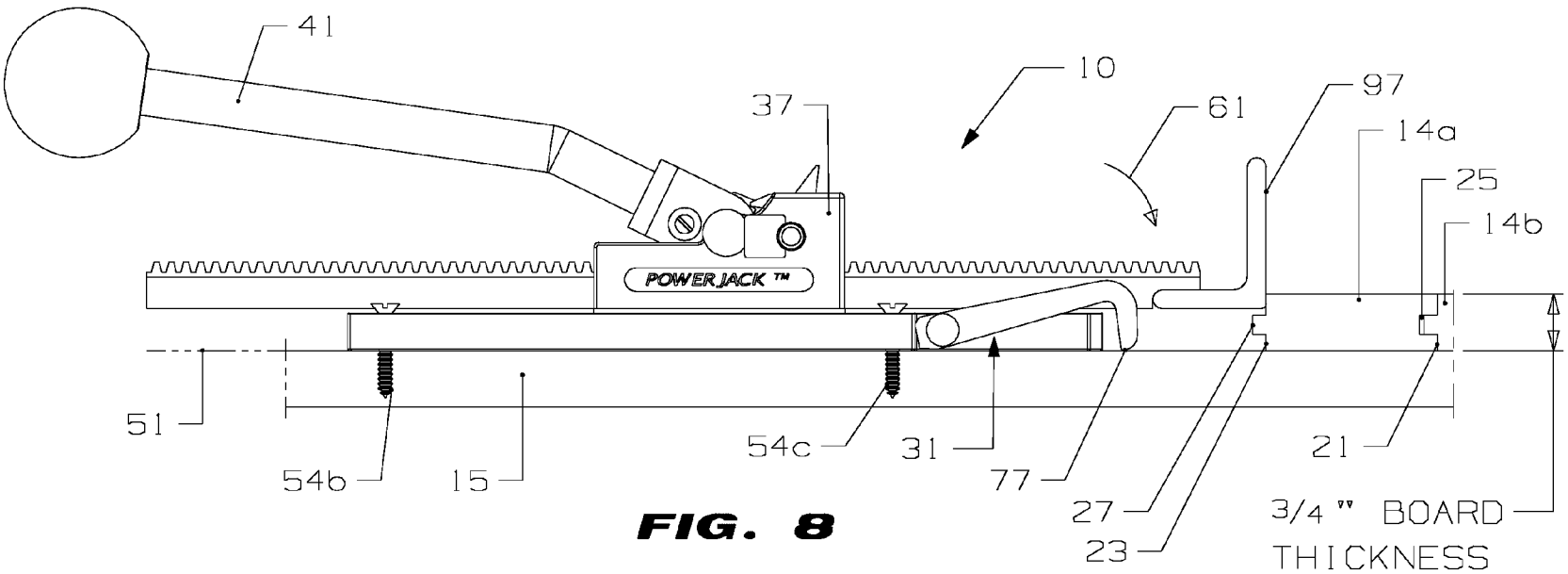
FIG. 8 is a side elevation view of the exemplary jack of FIG. 1 showing use in a pushing mode of operation with exemplary flooring elements having a nominal ¾ inch thickness.

Referring to FIGS. 6-8, exemplary jack 10 may be used with flooring elements 11*a*-11*f*, 13*a*-13*e*, 14*a*-14*b* which are strip-type elements which are generally flat relative to their length or width. In the examples, elements 11*a*-11*f*, 13*a*-13*e*, 14*a*-14*b* include a tongue-and-groove configuration to facilitate moving or joining together of such flooring elements. Such elements may be referred to as planks or boards. While strip-type flooring elements 11*a*-11*f*, 13*a*-13*e*, 14*a*-14*b* are shown, the flooring elements may have any shape and may, for example, be rectangles (e.g., parquet squares), or pre-manufactured groups of joined-together elements, such as laminates. Types of connections, other than tongue-and-groove connections, may be utilized.

FIGS. 6-8 illustrate ends of flooring elements 11*a*-11*f*, 13*a*-13*e*, and 14*a*-14*b*. Flooring elements 11*a*-11*f*, 13*a*-13*e*, and 14*a*-14*b* each include a top surface 17, a bottom surface 19 which rests on subfloor 15 or other support, and a pair of flooring element side portions 21, 23. Elements 11*a*-11*f*, 13*a*-13*e*, 14*a*-14*b* have a width dimension between side portions 21, 23 and a thickness dimension between top and bottom surfaces 17, 19 as illustrated in the examples of FIGS. 6-8. Elements 11*a*-11*f*, 13*a*-13*e*, 14*a*-14*b* further include a length dimension which is not illustrated in FIGS. 6-8. The dimensions shown are merely exemplary.

One side portion 21 is provided with a female groove 25 and the other side portion 23 is provided with a male tongue 27. Tongue 27 is received in groove 25 to join the flooring elements 11*a*-11*f*, 13*a*-13*e*, 14*a*-14*b* together. The cleat, nail or other fastener may be driven at an angle into the side portion 21 or 23 so that the fastener is hidden when adjacent flooring elements (e.g. element 11*a* and 11*b*) are joined together.

Jack 10 may advantageously be used with flooring elements (e.g., elements 11*a*-11*f*, 13*a*-13*e*, 14*a*-14*b*) having thickness dimensions which are different. By way of example only, jack 10 is capable of use with flooring elements 11*a*-11*f* having a nominal thickness of ½ A inch (FIG. 6), and with flooring elements 13*a*-13*e*, 14*a*-14*b* having a nominal thickness of ¾ inch (FIGS. 7-8). A single jack 10 is advantageously capable of use with a plurality of different flooring element thicknesses, thereby avoiding the necessity for use of separate tools with flooring of different thicknesses.

Flooring element installation typically, but not always, involves securing one flooring element (e.g., element 11*e*, 14*b*, or 13*d*) to the subfloor 15 or other support. The installer then joins an unsecured flooring element (e.g., element 11*f*, 13*e*, or 14*a*) into contact with the secured flooring element by means of a rubber mallet. This newly-joined flooring element 11*f*, 13*e*, or 14*a* is then secured to subfloor 15 (or other support) and the process is repeated as the floor is installed. Jack 10 may be used to facilitate joining of the elements or for straightening warped elements encountered during installation.

Jack 10 has particular utility in joining or moving an unsecured flooring element (e.g., element 11*f*, 13*e*, or 14*a*) near a vertical wall, cabinet surface or another confined space where a rubber mallet cannot be swung without risk of damage to the wall, cabinet or other obstruction. The pulling capability of jack 10 is particularly useful next to a wall or cabinet because the wall or cabinet can be used as a surface for contact by jack 10 as described below. Jack 10 may be used to move one flooring element, or to simultaneously move a group of flooring elements. Jack 10 may be used for other applications, such as to move an element (e.g. element 11*a*) into abutment with a baseboard molding, wall, cabinet or other surface before the element is secured in place. Jack 10 can be used in other applications where pulling or pushing is desired.

In the example, jack 10 includes a base 29 with a base axis 30, a puller 31 pivotably attached to base 29, a ram 33, and a ram-drive mechanism 34 in power-transmission relationship with ram 33 operative to extend ram 33 from base 29 along axis 30 to exert a force for joining the flooring elements 11*a*-11*f*, 13*a*-13*e*, and 14*a*-14*b* together. A preferred ram-drive mechanism 34 includes a rack 35 attached to the ram 33, a gear housing 37 including a pinion gear 39 meshed with rack 35, and a lever 41 operable to extend ram 33 from base 29 along axis 30 by means of the rack 35 and pinion 39.

Exemplary base 29 has a top 43, a bottom 45, a first end 47, and a second end 49. In the example, first end 47 may be considered a front end and second end 49 may be considered a rear end. Bottom 45 is preferably planar (i.e., flat) to enable jack 10 to rest on a subfloor 15 (FIG. 8), on the top surface 17 of flooring elements 11*a*-11*f*, 13*a*-13*e* (FIGS. 6-7), a joist, or another support surface. In such embodiment, bottom 45 defines a plane 51. In a horizontal flooring application, parts or things toward the jack 10 side of plane 51 (including parts in the plane 51) may be considered above the bottom 45 while parts or things on the opposite side of plane 51 may be considered below or beneath the bottom 45.

In the example, base 29 optionally includes a toe 50. A preferred toe 50 is a necked-in, or narrower portion, of base 29 adjacent first end 47. Toe 50 rests on one or more flooring element 11*a* or 13*e* when jack 10 is in the pulling mode of operation to prevent the flooring element 11*f* or 13*e* from being lifted up and off of subfloor 15 when force is applied to the flooring element side portion 21 or 23 through puller 31. Puller 31 is preferably mounted along outer sides 52, 54 of toe 50 so that toe 50 will be in position directly against the top surface 17 of the flooring element 11*f*, 13*e* being pulled by puller 31 to limit movement of the flooring element off of the subfloor 15 or other surface when force is applied by jack 10 for pulling.

Exemplary base 29 is provided with four openings, or holes, 53*a*, 53*b*, 53*c*, 53*d*. Openings 53*a*-53*d* are provided to receive fasteners 54*a*, 54*b*, 54*c* (a fourth fastener is hidden behind gear housing 37 in FIG. 1). The fasteners 54*a*-54*c* are preferably screws used to secure base 29 to subfloor 15 or another support when jack 10 is in the pushing mode of operation.

Referring to FIGS. 4 and 5A-5E, exemplary puller 31 is pivotably attached to base 29. It is to be understood that puller 31 may be pivotably attached directly or indirectly to base 29 in any suitable manner, including by intermediate structure. Most preferably, puller 31 is pivotably attached to base 29 along toe 50 sides 52, 54 by means of a staked pin 55 frictionally seated in opening 57 in toe 50 portion of base 29 and through puller openings 59*a*, 59*b*. This arrangement permits puller 31 to pivot in a first direction indicated by arrow 61 and to pivot in a second, or opposite, direction to the first direction. Preferably, puller 31 freely pivots about pin 55 adjacent toe 50 in the first or second direction to "self-adjust" to a position to contact the flooring element (e.g., elements 11*a*-11*f* or 13*a*-13*e*) based on the flooring element thickness as described below. In the examples of FIGS. 6-8, the self-adjusting pivoting movement of puller 31 is possible merely by the force of gravity and without need for a mechanical device to move puller 31 in a direction toward or away from arrow 61.

Pivotable attachment of puller 31 to base 29 advantageously avoids risk of loss of puller 31. As can be appreciated, a flooring installer or a carpenter must transport his tools from job site to job site and there is a significant risk that the puller 31 could be lost during such movement if puller 31 were free from jack 10. Loss of puller 31 would partially disable jack 10 because jack 10 could not be used in its pulling mode of operation. Pivotable attachment of puller 31 to base 29 further avoids the necessity for a separate tool to remove or mount puller 31 and avoids the necessity for separate fasteners or parts to mount puller 31 to base 29.

Figure 2:
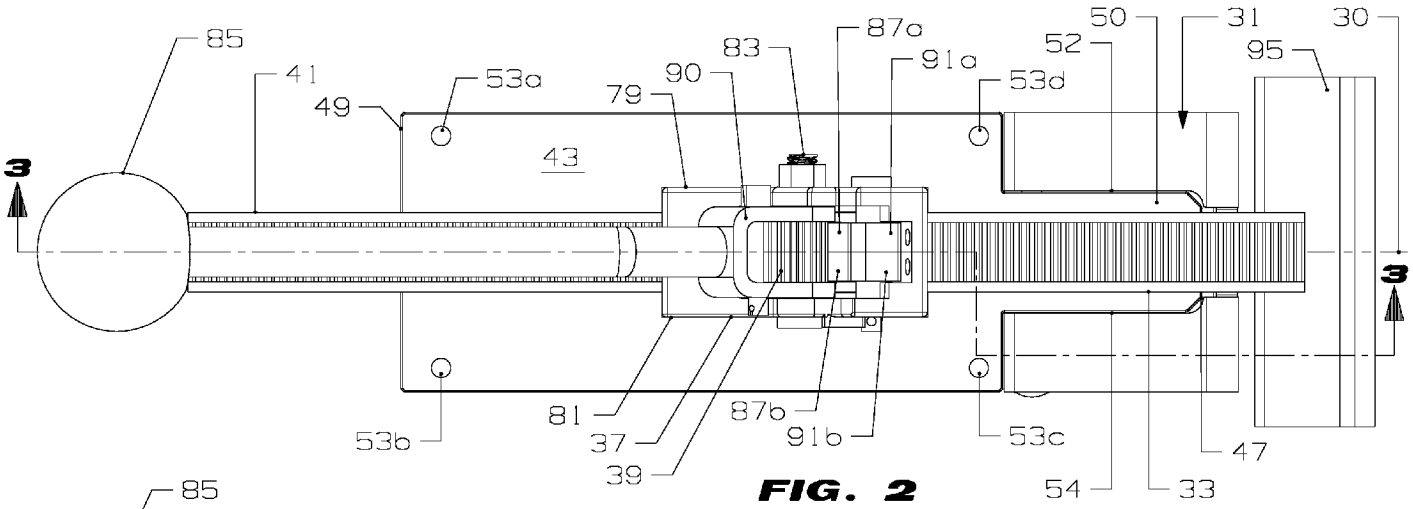
FIG. 2 is a top plan view of the exemplary jack of FIG. 1.
Figure 4:
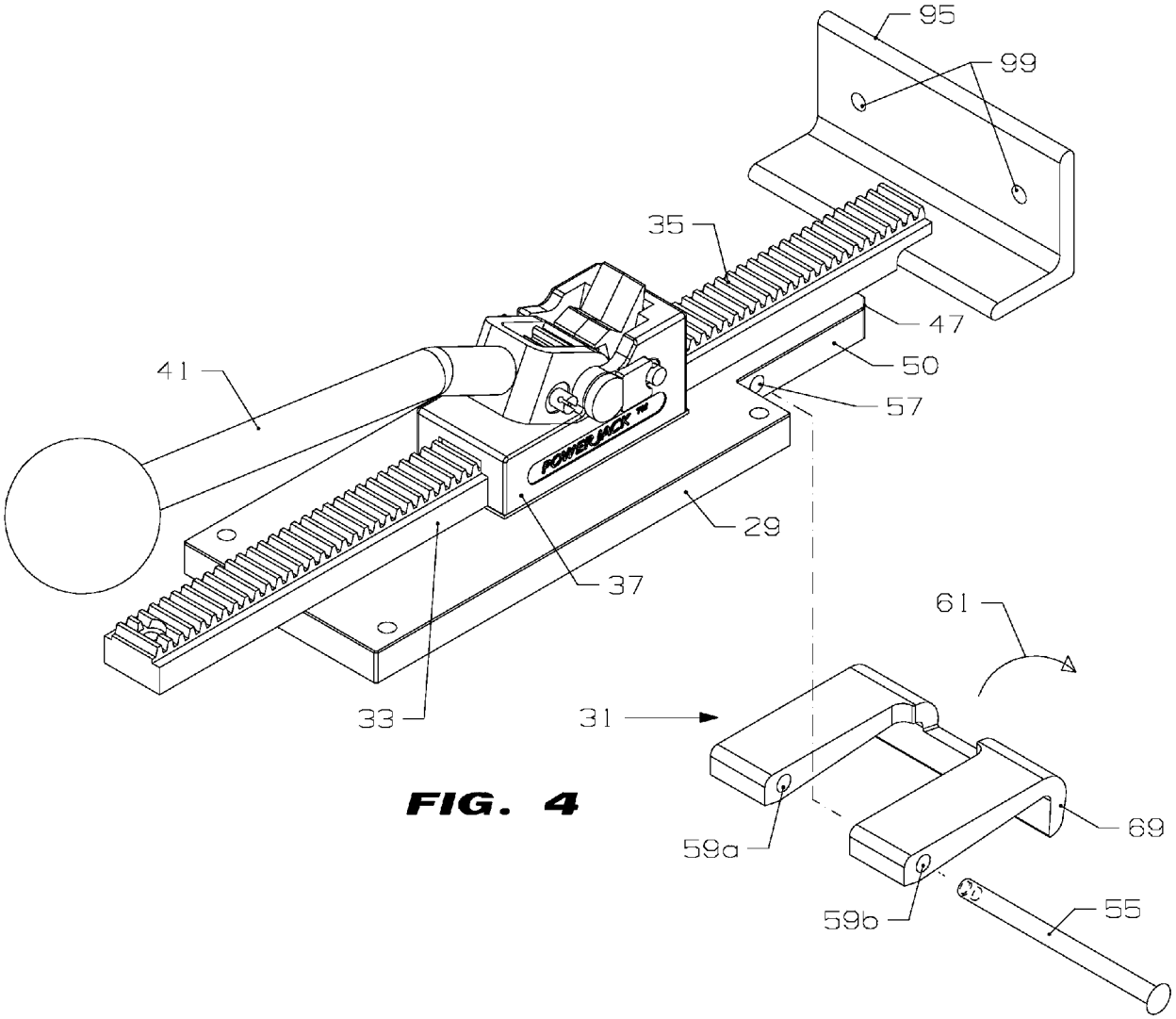
FIG. 4 is a partially exploded view of the exemplary jack of FIG. 1.

Referring again to FIGS. 4 and 5A-5E, puller 31 preferably includes a one-piece, or unitary, body 63. Preferred body 63 includes a pair of spaced-apart arms 65, 67, and a flooring element contact portion in the form of a flange 69 which extends across arms 65, 67. Exemplary body 63 further includes a bottom side 71 and a top side 73. In the embodiment, arms 65, 67 are located along the outer sides of toe 50 as illustrated in FIGS. 2 and 4 and flange 69 extends away from body 63 and away from arms 65, 67. Exemplary flange 69 is generally normal, or perpendicular, to axis 30 and includes a pulling surface 75 for contacting and pulling a flooring element side portion 21 or 23 and flange 69 further includes a distal end 77 which rests on subfloor 15 or a flooring element top surface 17 during jack 10 use. The dimension between body bottom side 71 and distal end 77 is a flange 69 length dimension. Pulling surface 75 need not contact the entirety of side portion 21 or 23 between element top 17 and bottom surfaces 19.

Puller 31 body 63 further defines a slot 78 between arms 65, 67 to permit travel of ram 33 through puller 31 along axis 30 when the jack 10 is in the pushing mode of operation with puller 31 distal end 77 on subfloor 15 and puller 31 pivoted in the second direction, opposite of the first direction (i.e., the direction of arrow 61).

Figure 5B:
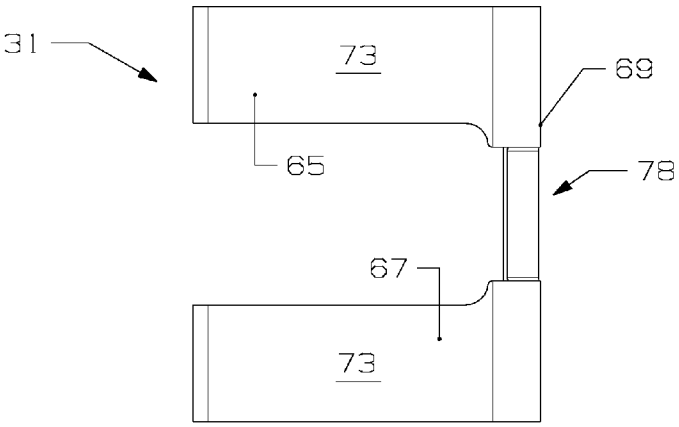
FIG. 5B is a top plan view of the exemplary puller of FIG. 5A.
Figure 5C:
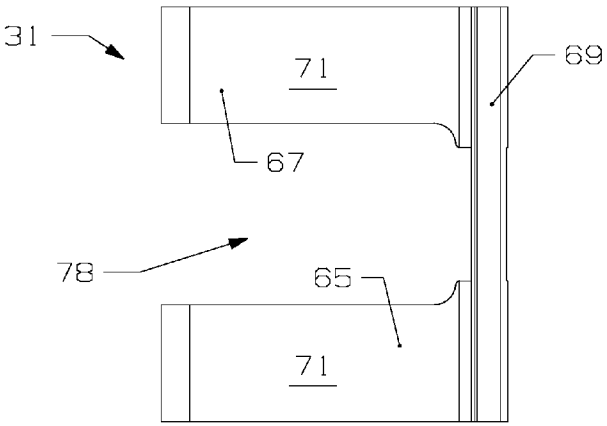
FIG. 5C is a bottom plan view of the exemplary puller of FIG. 5A.
Figure 5A:
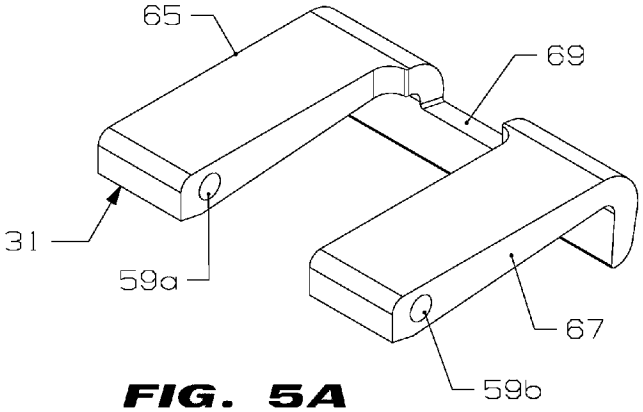
FIG. 5A is an isometric view of an exemplary puller for use with the exemplary jack of FIG. 1.
Figure 5E:
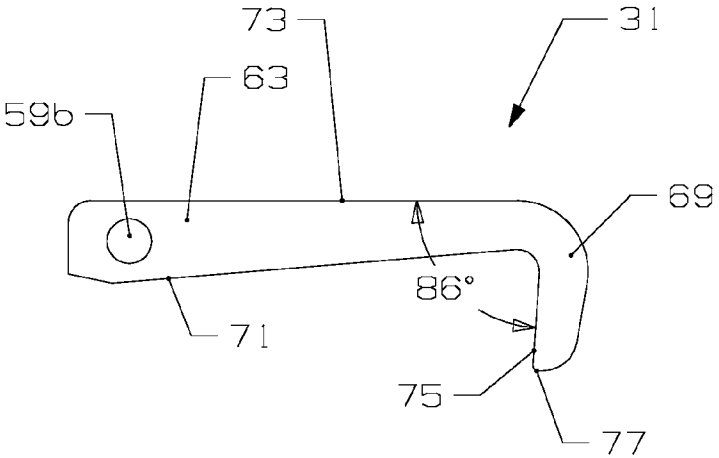
FIG. 5E is a side elevation view of the exemplary puller of FIG. 5A.
Figure 5D:
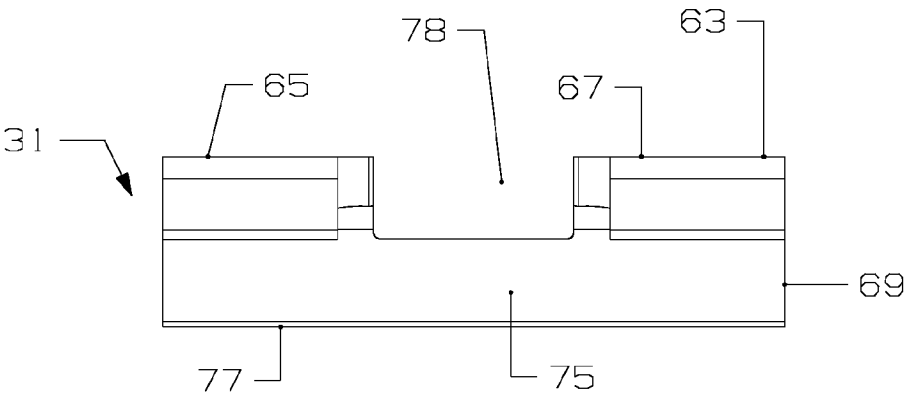
FIG. 5D is a front end elevation view of the exemplary puller of FIG. 5A.

In a preferred embodiment, exemplary flange 69 has the appearance of a "hook" in a side elevation view as illustrated in FIG. 5E. The exemplary body 63 hook-like configuration results from manufacture of flange 69 so that there is about an 83° to about an 87° angle between body top side 73 and pulling surface 75 located on puller 31 flange 69. This angle is referred to herein as a "flange angle." FIG. 5E illustrates a preferred 86° flange angle. This preferred hook-like configuration is particularly useful when using jack 10 in a pulling mode of operation with flooring elements that have a relatively thin thickness dimension which is less than the flange 69 length dimension. As illustrated in FIG. 6, if flooring element 11*a*-11*f* has a thickness less than the flange length dimension, then flange distal end 77 will rest on subfloor 15. Provision of the hook-like configuration enables pulling surface 75 located on puller 31 flange 69 to rest more directly against flooring element side portion 21 or 23, thereby keeping puller 31 in contact with the flooring element side portion 21 or 23 when force is applied by ram 33 when jack 10 is in the pulling mode of operation. Without such flange angle, pulling surface 75 could angle away from flooring element side portion 21 or 23, potentially causing puller 31 to slip off the flooring element (e.g., element 111) when force is applied by ram 33.

Figure 3:
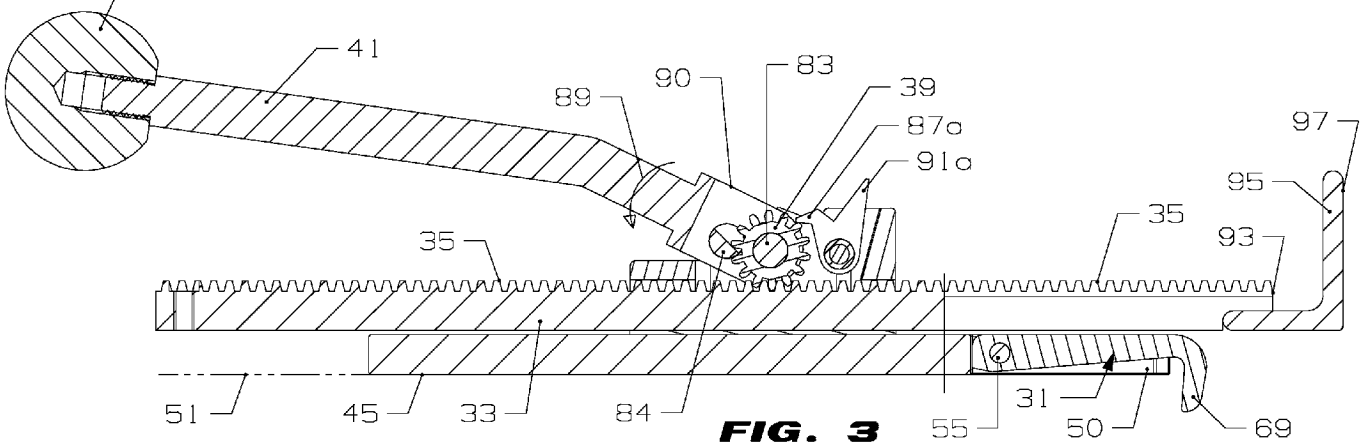
FIG. 3 is a section view of the exemplary jack of FIG. 1 taken along section line 3-3 of FIG. 2.

Referring now to FIGS. 2-3, gear housing 37 of ram-drive mechanism 34 is secured to base top 43. Gear housing 37 has first and second sides 79, 81 supporting shaft 83 for pinion gear 39. Lever 41 includes a one-way clutch 84. Clutch 84 meshes with teeth of pinion gear 39 when lever 41 pivots rearward toward base second end 49 to power pinion gear 39 in the direction of arrow 89. Clutch 84 floats over teeth of pinion gear 39 when lever 41 is pivoted in the forward toward base first end 47 so that movement of lever 41 does not power pinion gear 39 rotation. Rotation of pinion gear 39 on shaft 83 in the direction of arrow 89 drives rack 35 to extend ram 33 from base 29. Knob 85 is provided to enable easy grasp of lever 41 with the user's hand.

Pawls 87*a* and 87*b* are supported on gear housing 37 and are each biased toward pinion gear 39 by a spring (not shown). Pawls 87*a*, 87*b* ride over pinion gear 39 teeth when pinion gear 39 rotates in the direction of arrow 89 during rearward lever 41 movement resulting in ram 33 extension. Pawls 87*a*, 87*b* prevent reverse rotation of pinion gear 39 (i.e., in a direction opposite to arrow 89) permitting forward lever 41 movement (with one-way clutch 84 disengaged) toward base first end 47 to a position ready for a further rearward lever 41 stroke. Pawls 87*a*, 87*b* are configured so that one pawl 87*a* or 87*b* is slightly longer than the other. This ensures that one pawl 87*a* or 87*b* is constantly in contact with a tooth of pinion gear 39. This arrangement avoids reverse rotation of pinion gear 39 (i.e., in a direction opposite arrow 89) when ram 33 is applying a force.

Ram 33 may be manually retracted by release of pawls 87*a*, 87*b* from pinion gear 39 teeth. Pawls 87*a*, 87*b* may be released by forward pivoting movement of lever 41 (i.e., toward base first end 47) to bring lever 41 yoke 90 into contact with pawl releases 91*a*, 91*b* thereby releasing contact between pawls 87*a*, 87*b* and pinion gear 39 enabling free rotation of pinion gear 39 in the direction opposite of arrow 89. This reverse rotation of pinion gear 39 is possible because of one-way clutch 84 which rides over the pinion gear 39 teeth during reverse rotation of pinion gear 39. With pinion gear 39 capable of free rotation, ram 33 can be easily retracted toward base 29 along axis 30 by release of the force applied by ram 33 or by user pushing. Pawls 87*a*, 87*b* may also be released from pinion gear 33 by user pushing of pawl releases 91*a*, 91*b*.

Exemplary ram 33 includes a distal end 93. A pusher 95 may optionally be provided at ram distal end 93. Exemplary pusher 95 may be an "L-shaped" angled element made of aluminum stock. Pusher front surface 97 is provided to push against a wall 101, a cabinet, a vertical wall stud or other surface during operation of jack 10 in either the pulling mode or the pushing mode of operation. Holes 99*a*, 99*b* may be provided in front surface 97 to receive screws (not shown) capable of securing a board, fence, or cushioning member (not shown) to front surface 97. The board, fence or cushioning member may be used to span between vertical wall studs (not shown) which are typically spaced about 16 inches apart or to avoid damage to drywall against which ram 33 may be pushing. Pusher 95 may have any suitable construction and may even be the distal end 93 of ram 33 itself.

Operation

Jack 10 is capable of operation in a pulling mode and, alternatively in a pushing mode as previously mentioned. Both the pulling mode of operation and the pushing mode of operation are capable of moving one or more flooring element 11*a*-11*f*, 13*a*-13*e*, 14*a*-14*b* as a group or by moving one element against another element previously secured in place. Jack 10 can hold one or more of the flooring elements 11*a*-11*f*, 13*a*-13*e*, 14*a*-14*b* tightly together for hands-free nailing to a subfloor 15 or another support, such as a joist (not shown).

Pulling Mode of Operation

FIGS. 6-7 illustrate exemplary jack 10 in the pulling mode of operation. The pulling mode of operation has particular utility when installing flooring elements (e.g., elements 11*d*, 11*e* or 13*d*, 13*e*) in close proximity to a wall 101, cabinet or other obstruction that would prevent use of a mallet or that would prevent jack 10 from being positioned for pushing. In the pulling mode of operation, base 29 rests on top surface 17 of flooring elements 11*a*-11*f* or 13*a*-13*e* as illustrated in FIGS. 6-7. Toe 50 of base 29 rests on the top surface 17 of the flooring element being moved (e.g., element 11*f* or 13*e*). Ram 33 is extended out from base 29 along axis 30 so that pusher 95 front surface 97 is against wall 101 or another suitable surface. Jack 10 can also be used in a pulling mode of operation spaced from wall 101 by setting a stationary anchor point, such as a stud fastened to subfloor 15, anywhere near the work area.

Jack 10 is positioned so that puller 31 is in contact with flooring element side portion 21 or 23. In the example, puller 31 pivots about staked pin 55 in the first direction indicated by arrow 61 until either flange distal end 77 contacts subfloor 15 or puller body bottom 71 contacts a flooring element top surface 17. Puller 31 is preferably free to pivot in the first direction until such contact is made. The position of puller 31 in proper position against a flooring element side portion 21, 23 for application of the pulling force represents a puller 31 "pulling position." In the example, no separate mechanism is required to adjust the position of puller 31 to the pulling position. Such pivoting movement enables puller 31 to quickly self-adjust to contact the flooring element side portion 21 or 23 at the pulling position based on the flooring element thickness between top 17 and bottom 19 surfaces. Moreover, the pivoting movement of puller 31 enables puller 31 to immediately self adjust to the pulling position to accommodate virtually any flooring element thickness. This aspect of puller 31 self-adjustment represents an improvement over removable "foot" systems which may have a more limited range of movement, or no movement at all.

Puller self-adjustment with respect to a relatively thin flooring element is illustrated in FIG. 6. In the example of FIG. 6, flooring elements 11*a*-11*f* are each of a ½ inch nominal thickness, which is a thickness less than the flange length between puller body bottom 71 and flange distal end 77. Accordingly, flange distal end 77 rests on subfloor 15. The exemplary 86° flange angle in the pulling position illustrated in FIG. 5E enables pulling surface 75 of puller 31 flange 69 to be at approximately a 90° angle to subfloor 15 to approach being co-planar (i.e., flush) with tongue 27. The flange angle prevents puller 31 from slipping off of the flooring element 11*f* or 13*e* when force is applied by ram 33.

Puller self-adjustment with respect to a relatively thick flooring element is illustrated in FIG. 7. In the example of FIG. 7, flooring elements 13*a*-13*e* are each of a ¾ inch nominal thickness, which is a thickness greater than the exemplary flange length between puller body bottom 71 and flange distal end 77. Accordingly, flange body bottom 71 rests on top surface 17 of element 13*e*. The exemplary 86° flange angle which provides the hook-like configuration of puller 31 body 63 enables pulling surface 75 of puller 31 flange 69 to wrap partially around tongue 27 in the pulling position, again preventing puller 31 slippage off of the flooring element 11*f* or 13*e* when force is applied by ram 33.

With puller 31 in the pulling position and in place against flooring element side portion 21 or 23, ram 33 may be extended from base 29 away from base first end 47 (forward in the example) by operation of rack 35 and pinion 49 of ram-drive mechanism 34. User grasping of knob 85 and movement of lever 41 toward base second end 49 (rearward in the examples) rotates pinion gear 49 against rack 35 to extend the ram 33. Movement of lever 41 back-and-forth further advances ram 33.

Referring again to FIGS. 6-7, with ram 33 pusher 95 positioned against wall 101 and puller 31 pulling surface 75 against flooring element side portion 23, lever 41 is pivoted rearward causing the ram-drive mechanism 34 to extend ram 33 from base 29. Ram 33 applies force in a direction opposite of ram 33 movement or extension which pulls the flooring element 11*f* or 13*e* by extension of the ram 33 against wall 101 with puller 31 in contact with the flooring element side portion 23. During force application, toe 50 applies a further force against flooring element 11*f*, 13*e* top surface 17 to prevent the flooring element 11*f*, 13*e* from being lifted off of subfloor 15. Consequently, flooring element bottom 19 remains in contact with subfloor 15. Application of the force by ram 33 moves puller 31 and flooring element 11*f*, 13*e* away from wall 101 to join and hold flooring element 11*f* against element 11*e* or element 13*e* against element 13*d*. Flooring elements 11*f* and 13*e* can then be set in place with an appropriate fastener or adhesive. Toe 50 positioned against flooring element top surface 17 facilitates setting in place of the flooring elements 11*f*, 13*e* by keeping elements 11*f*, 13*e* in place against subfloor 15.

Pushing of pawl releases 91*a*, 91*b* with yoke 90 releases pawls 87*a*, 87*b* and enables ram 33 to be retracted, thereby removing the force. Jack 10 can then be moved for installation of the next flooring element and this process is repeated as needed until the floor is completely installed.

Pushing Mode of Operation

FIG. 8 illustrates exemplary jack 10 in the pushing mode of operation. The pushing mode of operation is typically employed mid-floor to join flooring elements, such as flooring elements 14*a*, 14*b* in FIG. 8, tightly together. Jack 10 can be repositioned as needed for this purpose.

In the pushing mode of operation, base 29 is secured directly to the subfloor 15, or to another suitable support by fasteners 54*a*-54*c* (a fourth fastener is not shown in FIG. 1) inserted through respective base openings 53*a*-53*d*. The bottom surface 19 of each flooring element 14, 14*b* lies in plane 51 defined by base bottom 45 and the upper surface of subfloor 15. The flooring elements 14*a*, 14*b* are above base bottom surface 45 in this example.

Puller 31 is capable of self-adjusting movement in the second direction, opposite to the first direction (i.e., the direction opposite arrow 61) to enable base 29 to be secured to subfloor 15. As illustrated in FIG. 8, puller 31 pivots so that flange distal end 77 rests on subfloor 15 and in plane 51 defined by base bottom 45 with ram 33 located within slot 78 of the puller body 63. Slot 78 is sufficiently deep to permit self-adjusting pivoting movement of puller 31 based on the flooring element thickness.

Also as illustrated in FIG. 8, puller 31 is in a position out of contact with a flooring element 14*a* during flooring element pushing because ram 33 is extended from base 29 along axis 30 to push against side portion 23 (or 21) of flooring element 14*a* with ram 33 traveling through slot 78 as ram 33 is extended. The position of puller 31 in FIG. 8 in contact with flooring element 14*a* side portion 23 for application of the pulling force represents a puller 31 "pushing position."

Referring again to FIG. 8, with base 29 secured to subfloor 15 and ram 33 pusher 95 positioned against flooring element 14*a* side portion 23, lever 41 is pivoted rearward causing the ram-drive mechanism 34 to extend ram 33 from base 29. Ram 33 applies a force which pushes flooring element 14*a* toward element 14*b* by extension of ram 33 against the flooring element 14*a* side portion 23. The pushing force is applied in a direction of ram 33 movement or extension. Flooring elements 14*a* and 13*a* can then set in place with an appropriate fastener or adhesive.

As already noted, pushing of pawl releases 91*a*, 91*b* with yoke 90 enables ram 33 to be retracted by user pushing of ram 33, thereby removing the force. Ram 33 can then be retracted a sufficient distance to enable the next flooring element to be joined by a further extension of ram 33. This process is repeated until ram 33 can no longer be retracted an adequate distance to position the next flooring element. At this point, the fasteners 54*a*-54*c* securing base 29 to subfloor 15 are removed and jack 10 is moved so that base 29 can again be secured to subfloor 15 for further flooring element installation.

It will be apparent from the foregoing description that jack 10 has numerous advantages. Jack 10 is capable of pulling and pushing with a single tool, thereby avoiding the need for the flooring installer or carpenter to have separate tools for these purposes. Pivotable attachment of puller 31 with respect to jack 10 avoids potential loss of a removable-type part and avoids the need for tools, fasteners or other parts to mount or remove such a part. The time required to mount and remove a separate part from the jack is avoided as well. The pivotable puller 31 quickly and easily self-adjusts to accommodate flooring elements (e.g., elements 11*a*-11*f* or 13*a*-13*e*, or 14*a*-14*b*) having a wide range of different thicknesses. The optional flange angle enables puller 31 to better contact flooring element side portion 21 or 23 in the pulling mode of operation, thereby preventing puller 31 from slipping off of the flooring element 11*f* or 13*e* when force is applied by ram 33. These and other features of jack 10 make flooring installation more efficient.

While the exemplary jack 10 has been described in connection with installation of flooring elements, it is envisioned that jack 10 could have applications for joining other types of elements and such elements are encompassed within the meaning of flooring element. Examples of other types of elements include dock planks, decking and other materials, whether horizontal or vertical once installed.

While the principles of this invention have been described in connection with specific embodiments, it should be understood clearly that these descriptions are made only by way of example and are not intended to limit the scope of the invention.

What is claimed is:

1. A jack for moving a flooring element by pulling or by pushing, the jack comprising:

a base;

a puller pivotably attached to the base capable of pivoting movement in a first direction to a position enabling puller contact with a flooring element side portion during flooring element pulling and, alternatively, pivoting movement in an opposite direction to a position out of contact with a flooring element during flooring element pushing;

a ram extendable from the base capable of applying (a) a force which pulls the flooring element by extension of the ram against a fixed surface with the puller in contact with the flooring element side portion thereby to move the puller and flooring element away from the fixed surface and, alternatively, (b) a force which pushes the flooring element by extension of the ram against the flooring element side portion with the jack secured to a support; and a ram-drive mechanism in power-transmission relationship with the ram operative to extend the ram.

2. The jack of claim 1 wherein the puller is capable of self-adjusting pivoting movement in the first direction for contact with the flooring element side portion based on a thickness of the flooring element.

3. The jack of claim 2 wherein the base includes a toe capable of placement against a flooring element top side proximate the puller to prevent lifting of the flooring element during application of the pulling force.

4. The jack of claim 3 wherein the puller comprises:

a body pivotably attached to the base proximate the toe, the body defining a slot to permit travel of the ram through the puller when the base is on the support; and a flooring element contact portion extending away from the body for contact with the flooring element side portion.

5. The jack of claim 4 wherein the flooring-element contact portion is a flange.

6. The jack of claim 5 wherein:

the body includes a pair of spaced-apart arms defining at least a portion of the slot therebetween, each arm being pivotably attached to the base on an opposite side of the toe; and the flange extends across the arms.

7. The jack of claim 6 wherein the body includes a flange angle between a body top side and a pulling surface on the flange of about 83 degrees to about 87 degrees.

8. The jack of claim 6 wherein the ram comprises:

a bar having a distal end; and a pusher attached to the bar distal end.

9. The jack of claim 8 wherein the pusher includes a front surface for contacting the fixed surface during flooring element pulling and, alternatively, the flooring element side portion during flooring element pushing.

10. The jack of claim 9 wherein the ram-drive mechanism comprises:

a rack along the bar;

a pinion meshed with the rack;

a one-way clutch; and a lever which powers pinion rotation through the one-way clutch to extend the ram.

11. The jack of claim 10 wherein the base defines at least one fastener-receiving opening for receiving a fastener capable of securing the base to the support during flooring element pushing.

12. A jack for moving a flooring element by pulling or by pushing, the jack comprising:

a base having an axis and a bottom which supports the jack on a surface;

a puller pivotably attached to the base having a pulling surface generally normal to the axis, the puller being capable of pivoting movement to a pulling position in which the pulling surface is in contact with a flooring element side portion below the bottom and the surface supporting the jack and, alternatively, to a pushing position in which the pulling surface is above the bottom and out of contact with a flooring element;

a ram extendable from the base along the axis capable of applying a pulling force in a direction opposite of ram extension through the puller against the flooring element side portion in contact with the pulling surface below the bottom and the surface supporting the jack and, alternatively, a pushing force through the ram in a direction of ram extension against the flooring element side portion above the bottom; and a ram-drive mechanism in power-transmission relationship with the ram operative to extend the ram.

13. The jack of claim 12 wherein the puller comprises:

a body pivotably attached to the base extending outwardly from a base first end, the body defining a slot to permit travel of the ram through the puller when the puller is in the pushing position; and a flange extending away from the body for contact with the flooring element side portion when the puller is in the pulling position.

14. The jack of claim 13 wherein:

the body includes a pair of spaced-apart arms defining at least a portion of the slot therebetween, each arm being pivotably attached to the base; and the flange extends across the arms.

15. The jack of claim 14 wherein the puller is capable of self-adjusting pivoting movement to the pulling position for contact with the flooring element side portion based on a thickness of the flooring element.

16. The jack of claim 15 wherein the base includes a toe capable of placement against a flooring element top side proximate the puller to prevent lifting of the flooring element during application of the pulling force and each arm is pivotably attached to the base on an opposite side of the toe.

17. The jack of claim 16 wherein the body includes a flange angle between a body top side and the pulling surface of about 83 degrees to about 87 degrees.

18. The jack of claim 17 wherein the ram-drive mechanism comprises:

a rack along the ram;

a pinion meshed with the rack;

a one-way clutch; and a lever which powers pinion rotation through the one-way clutch to extend the ram.

19. The jack of claim 18 wherein the base defines at least one fastener-receiving opening for receiving a fastener capable of securing the base to the support during flooring element pushing.

20. A jack for moving a flooring element by pulling or by pushing, the jack comprising:

a base having a bottom an axis and a toe for placement against a flooring element top side during pulling;

a puller pivotably attached to the base proximate the toe and having a pulling surface generally normal to the axis, the puller being capable of self-adjusting pivoting movement based on a thickness of the flooring element to a pulling position in which the pulling surface is in contact with a flooring element side portion below the bottom and the flooring element top side and, alternatively, self-adjusting pivoting movement to a pushing position in which the pulling surface is above the bottom and out of contact with a flooring element;

a ram extendable from the base along the axis capable of applying a pulling force in a direction opposite of ram extension through the puller against the flooring element side portion in contact with the pulling surface below the bottom and the flooring element top side and, alternatively, a pushing force through the ram in a direction of ram extension against the flooring element side portion above the bottom; and a ram-drive mechanism in power-transmission relationship with the ram operative to extend the ram.

21. The jack of claim 20 wherein the puller comprises:

a body pivotably attached to the base extending outwardly from a base first end, the body defining a slot to permit travel of the ram through the puller when the puller is in the pushing position; and a flange extending away from the body for contact with the flooring element side portion when the puller is in the pulling position.

22. The jack of claim 21 wherein:

the body includes a pair of spaced-apart arms defining at least a portion of the slot therebetween, each arm being pivotably attached to the base; and the flange extends across the arms.

23. The jack of claim 22 wherein the body includes a flange angle between a body top side and the pulling surface of about 83 degrees to about 87 degrees.

24. The jack of claim 22 wherein the ram-drive mechanism comprises:

a rack along the ram;

a pinion meshed with the rack;

a one-way clutch; and a lever which powers pinion rotation through the one-way clutch to extend the ram.

25. The jack of claim 24 wherein the base defines at least one fastener-receiving opening for receiving a fastener capable of securing the base to a support during flooring element pushing.

* * * * *

UNITED STATES PATENT AND TRADEMARK OFFICE

CERTIFICATE OF CORRECTION

PATENT NO. : 8,434,738 B1
APPLICATION NO. : 12/880813
DATED : May 7, 2013
INVENTOR(S) : Anstett It is certified that error appears in the above-identified patent and that said Letters Patent is hereby corrected as shown below:

In the Specification

In column 4, line 33, delete "A".

In the Claims

In column 11, claim 5, line 7, delete the words "flooring-element" and replace with the words --flooring element--.

Signed and Sealed this
Thirteenth Day of May, 2014

Michelle K. Lee

Michelle K. Lee
*Deputy Director of the United States Patent and Trademark Office*